US012336634B2

(12) United States Patent
Yang

(10) Patent No.: US 12,336,634 B2
(45) Date of Patent: Jun. 24, 2025

(54) FOLDING BEDSTEAD AND BED

(71) Applicant: Zhejiang Hengfeng Top Leisure Co., Ltd., Zhejiang (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 394 days.

(21) Appl. No.: 17/994,476

(22) Filed: Nov. 28, 2022

(65) Prior Publication Data

US 2023/0414004 A1 Dec. 28, 2023

(30) Foreign Application Priority Data

Jun. 28, 2022 (CN) ..... 202221639985.9

(51) Int. Cl.

| | |
|---|---|
| ***A47C 17/72*** | (2006.01) |
| ***E04H 15/32*** | (2006.01) |
| ***E04H 15/48*** | (2006.01) |

(52) U.S. Cl.

CPC ..... *A47C 17/72* (2013.01); *E04H 15/324* (2013.01); *E04H 15/48* (2013.01)

(58) Field of Classification Search

CPC ..... E04H 15/324; E04H 15/48; A47C 17/72; A47C 29/003; A47C 4/48; A47C 4/286; A47C 19/126

See application file for complete search history.

(56) References Cited

U.S. PATENT DOCUMENTS

| | | | | |
|---|---|---|---|---|
| 5,645,259 | A * | 7/1997 | Chen | A47B 3/12 108/118 |
| 6,499,705 | B1 * | 12/2002 | Tsai | F16M 11/22 248/167 |
| 6,865,756 | B2 | 3/2005 | Clapper et al. | |
| 10,151,490 | B1 * | 12/2018 | Wolf | F24B 1/1808 |
| 10,194,755 | B1 | 2/2019 | Flannery et al. | |
| RE47,525 | E | 7/2019 | Sousa et al. | |
| 11,026,522 | B1 | 6/2021 | Flannery et al. | |
| 11,109,691 | B2 | 9/2021 | Fusco et al. | |
| 11,266,253 | B1 | 3/2022 | Flannery et al. | |
| D970,236 | S | 11/2022 | Pacella | |
| 2009/0315366 | A1 * | 12/2009 | Chen | A47C 4/286 297/16.1 |
| 2018/0238041 | A1 * | 8/2018 | Styrc | E04B 1/2608 |
| 2021/0037990 | A1 | 2/2021 | Pacella | |
| 2021/0085098 | A1 | 3/2021 | Pacella | |
| 2022/0372783 | A1 * | 11/2022 | Pacella | A47C 7/664 |

FOREIGN PATENT DOCUMENTS

| | | | |
|---|---|---|---|
| WO | 2021168431 | A1 | 8/2021 |

* cited by examiner

*Primary Examiner* — Justin C Mikowski
*Assistant Examiner* — Alison N Labarge
(74) *Attorney, Agent, or Firm* — Thompson Coburn LLP

(57) ABSTRACT

A folding bedstead includes multiple vertical poles and a top frame which is foldably mounted at the top ends of the vertical poles. The vertical poles are spaced apart. Connections between any two adjacent vertical poles form a loop. Any two adjacent vertical poles are connected by a connecting rod assembly, and the vertical poles are folded or unfolded by means of the connecting rod assembly. The top frame includes multiple top rods and a joint seat. One end of each of the top rods is rotatably connected to the top of the respective vertical pole, and the other end of each of the top rods is rotatably connected to the joint seat.

18 Claims, 4 Drawing Sheets

FOLDING BEDSTEAD AND BED

RELATED APPLICATION DATA

The present application claims priority benefit to Chinese utility model application serial no. 202221639985.9, filed Jun. 28, 2022, the disclosure of which is incorporated by reference herein.

FIELD

The present application relates to outdoor beds, and in particular to a jointly folding bedstead and a bed.

BACKGROUND

At present, most pet bed canopies on the market have a structure that the sunshade structure and the bed are folded separately, and have the problem of cumbersome installation and being easy to lose accessories. Moreover, many pet bed canopies have a large package volume and take up too much storage space.

SUMMARY

A bed with a folding bedstead may be configured in an expanded configuration and a folded configuration. The folding bedstead has:

multiple vertical poles connected together with a connecting rod assembly where any two adjacent vertical poles are connected by the connecting rod assembly, wherein in the expanded configuration, the connecting rod assemblies extend around the periphery of the bedstead and form a loop, the vertical poles being folded or unfolded by means of the connecting rod assembly; and a top frame which is foldably mounted at the top ends of the multiple vertical poles, where the top frame includes multiple top rods and a joint seat, one end of each of the top rods is rotatably connected to the top of the respective vertical pole, and the other end of each of the top rods is rotatably connected to the joint seat.

In some embodiments, the joint seat includes a seat body and multiple hinge positions formed at an upper end of the seat body, where the multiple top rods are rotatably connected at the hinge positions respectively, so that the top rods and the joint seat can be folded at the inner side of the vertical poles.

In some embodiments, each connecting rod assembly at least includes two connecting rods which are arranged crosswise, where the two connecting rods are rotatably connected to each other in the middle of each connecting rod.

In some embodiments, the bedstead further includes a sliding seat slidably connected to each vertical pole, where the sliding seat can vertically slide relative to the corresponding vertical pole, an upper end of each connecting rod is rotatably connected with the corresponding sliding seat, and a lower end of each connecting rod is rotatably connected with a lower side of the adjacent vertical pole.

In some embodiments, a support foot is provided at the bottom of each vertical pole, and a lower end of each connecting rod is pivoted on the corresponding support foot.

In some embodiments, the number of the vertical poles is four, the connection between two adjacent vertical poles around the periphery of the bedstead forms a loop in the shape of a rectangle, the four top rods are arranged crosswise at the top of the vertical poles along radial directions, and the joint seat is located at the cross position.

In some embodiments, an extension height of each vertical pole is not less than an extension length of each top rod.

In some embodiments, an upper part of each sliding seat forms a supporting surface to support a mattress.

The folding bed includes the above-mentioned bedstead, a mattress and a sunshade, where the mattress is sleeved on the multiple vertical poles; and the sunshade is at least sleeved over and/or on the top frame.

In some embodiments, the sunshade is sleeved over and on the top frame and the upper part of the vertical poles.

The folding bedstead provided by the present application can be folded jointly or all together in one motion, making folding more convenient, and in the folded configuration, the folded bedstead has a small packaging volume, which is convenient for users to store, and does not occupy too much space.

DETAILED DESCRIPTION OF THE EMBODIMENTS

Figure 1:
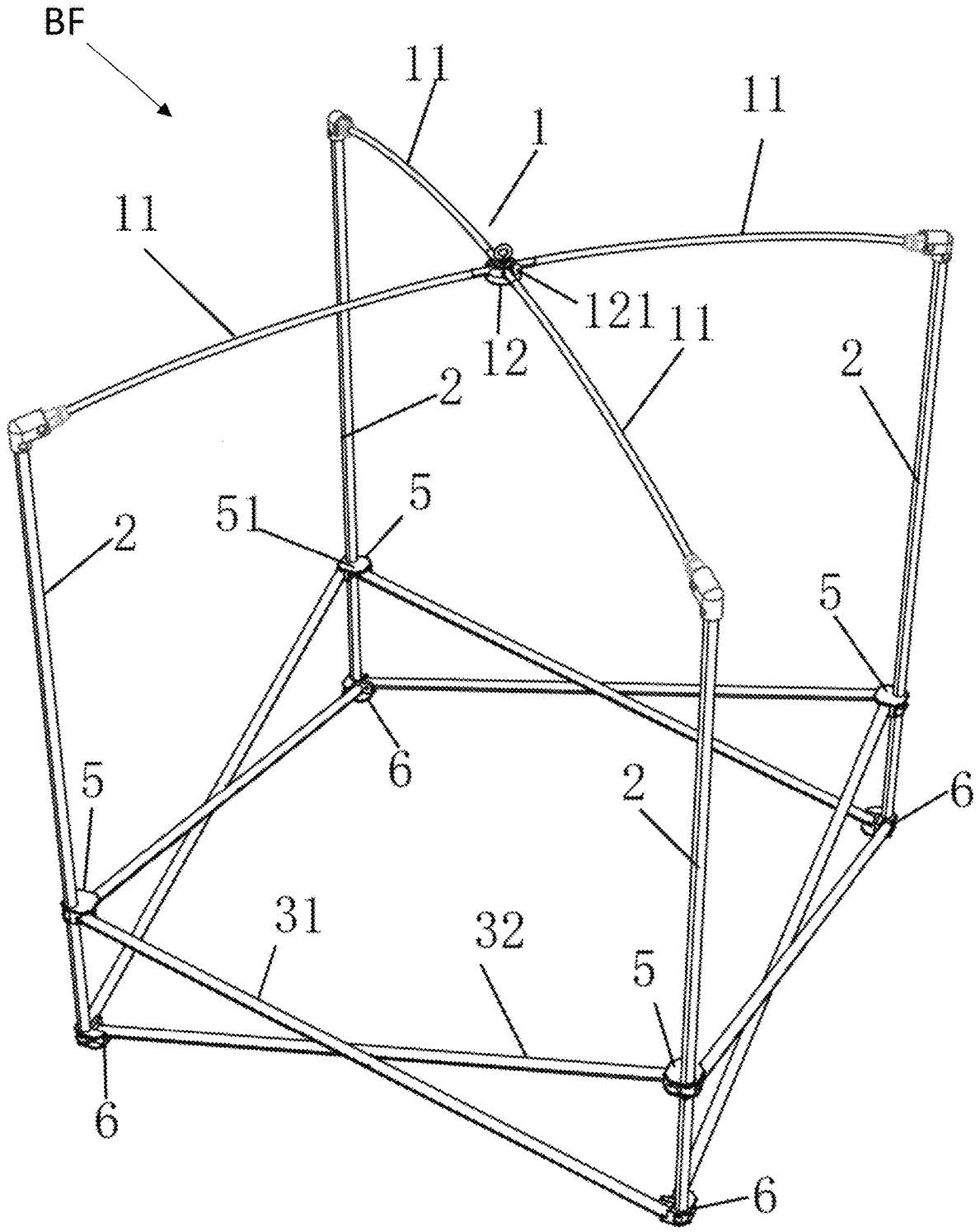
FIG. 1 is a schematic structural view of a bedstead provided by the present application.

Embodiments of the present application are described in detail below, examples of which are shown in the accompanying drawings. The embodiments described below with reference to the drawings are only exemplary embodiments which are used to explain the present application, and should not be construed to limit the present application.

In the description of the present application, it should be appreciated that the orientations or positional relationships indicated by the terms such as "upper", "lower", "front", "rear", "left", "right", "vertical", "radial", "top", "bottom", "inside", and "outside", are based on the orientation or positional relationship shown in the drawings, which are only used to facilitate the description of the present application and to simplify the description, rather than to indicate or imply that the devices or elements referred to must have a specific orientation or can only be configured and operated in a particular orientation. Therefore the above-mentioned terms should not be construed as a limitation to the present application. As shown in FIG. 1 to FIG. 4, a jointly folding bedstead (BF) is provided according to the present application, which includes multiple vertical poles 2 and a top frame 1 and is used for mounting a mattress 200 and a sunshade 100.

In the expanded configuration as shown in FIG. 1, the vertical poles 2 are spaced apart, so that the connection between adjacent vertical poles around the periphery of the bedstead forms a loop. The loop has a shape and defines a horizontal plane that is suitable for the installation of the mattress on the bedstead. The loop formed by the connection may be in the shape of a triangle, or a rectangle as shown in this embodiment of FIG. 1, or a polygon such as a pentagon. Any two adjacent vertical poles are connected by a connecting rod assembly, and the vertical poles are folded or unfolded by means of the connecting rod assembly. That is, any two adjacent vertical poles are folded by means of the connecting rod assembly, and are jointly folded together to fold the bedstead in the folded configuration. In some embodiments, each connecting rod assembly at least includes two connecting rods (31, 32) which are arranged crosswise, where the two connecting rods (31, 32) are rotatably connected to each other in the middle of each connecting rod. It is conceivable that each connecting rod assembly may also include multiple groups of crosswise arranged connecting rods, as long as these connecting rods can be folded in linkage to drive the vertical poles to fold or unfold. The crosswise arranged connecting rods may include a primary cross member and first and second secondary members. The first and second secondary members may extend from opposite sides of a hub and the primary member may extend through a channel in the hub. This arrangement may reduce the overall width of the connecting rods as the connecting rods pivot relative to the hub in the same vertical plane whereas in the embodiment of FIGS. 1-4, the connecting rods pivot in vertical planes spaced apart by the thickness of the connecting rod.

In the embodiments shown in FIGS. 1-4, the specific structure of the connecting rod assembly is as follows: the bedstead further includes a sliding seat 5 slidably connected to each vertical pole, where the sliding seat 5 can vertically slide relative to the corresponding vertical pole 2. An upper end of each connecting rod (31, 32) is rotatably connected with the corresponding sliding seat 5, and a lower end of each connecting rod is rotatably connected with a lower side of the adjacent vertical pole 2. Specifically, a support foot 6 is provided at the bottom of each vertical pole 2, and each support foot 6 is provided with a pivot point for a lower end of each connecting rod (31, 32) to be pivoted thereon. That is, each connecting rod assembly is rotatably connected with the corresponding sliding seat and the corresponding support foot. Such arrangement has the following advantages: firstly, the rotary or pivoting connection requirement of each connecting rod assembly is met; secondly, each sliding seat itself can also play a role of supporting the mattress on the vertical poles, the mattress is sleeved on the vertical poles, and the bottom of the mattress is supported on the sliding seats, so that the supporting force of the mattress is greater; and thirdly, the provision of the support feet improves the overall structural stability of the bedstead.

In this embodiment, an upper part of each sliding seat 5 forms a supporting surface 51 to support the mattress and improve the supporting force of the mattress.

Figure 2:
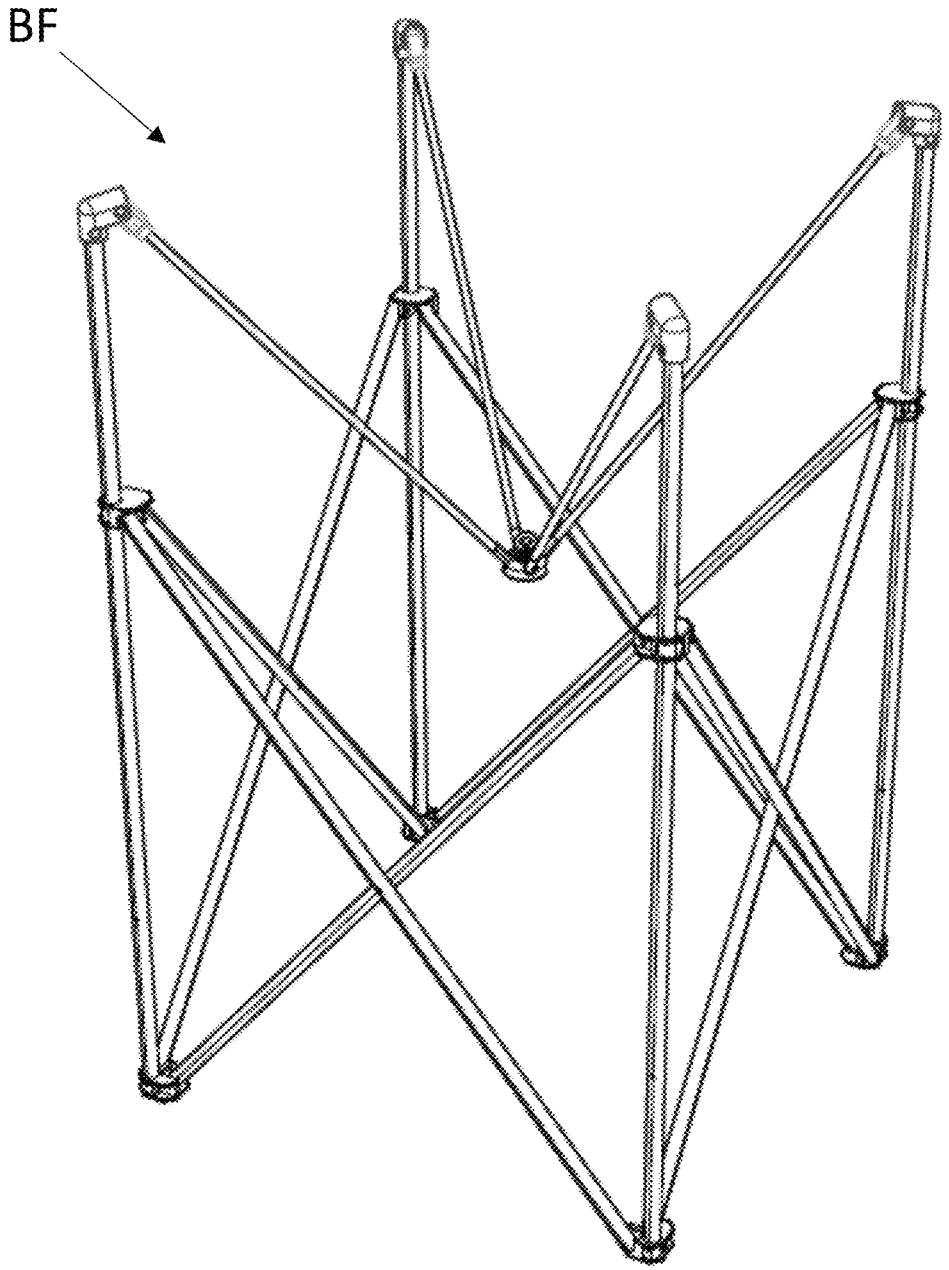
FIG. 2 is a schematic view of a folding process of the bedstead provided by the present application.
Figure 3:
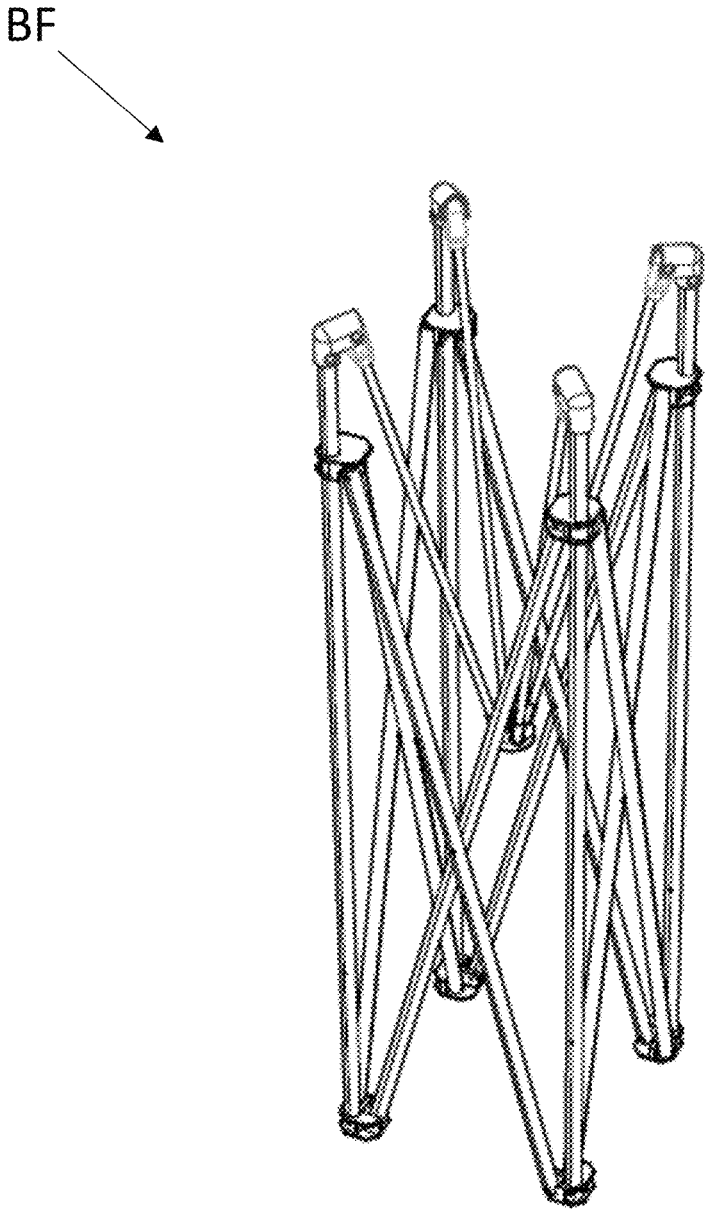
FIG. 3 is a schematic view of a folded state of the bedstead provided by the present application.

The top frame 1 is foldably mounted at the top ends of the multiple vertical poles, where the top frame includes multiple top rods 11 and a joint seat 12, one end of each of the top rods 11 is rotatably connected to the top of the respective vertical pole 2, and the other end of each of the top rods is rotatably connected to the joint seat 12. Thus, as shown in FIG. 2 and FIG. 3, when the user pushes and pulls the vertical poles 2 to fold, the top rods 11 can be jointly pulled to rotate and fold, and when the bedstead is opened, the vertical poles and the top rods can be jointly opened, so the operation is simple and quick.

The present application realizes the jointly folding of the bedstead through the hinge connection between the radially arranged top rods of the top frame and the foldable vertical poles, the folding can be realized without multiple steps, the folding is quick and simple, and the packaging volume is small after folding, which is convenient for storage.

There are many methods for folding the top frame, for example, the top frame can be folded at the upper side of the vertical poles, or at the inner side of the vertical poles, that is, the top frame is folded to be in the space enclosed by the vertical poles, so that the folding height and volume can be greatly reduced. In an embodiment, the joint seat 12 includes a seat body 121 and multiple hinge positions formed at an upper end of the seat body 121, where the top rods 11 are rotatably connected at the hinge positions respectively. In this way, the top rods and the joint seat pivot towards the inner side of the vertical poles instead of pivoting towards the upward side of the vertical poles, so that the top rods 11 and the joint seats 12 can be folded at the inner side of the vertical poles 2. That is, the additional top frame of the present application can be folded at the inner side of the vertical poles after folding, and does not increase the folding volume of the folding bed. Specifically, an extension height of each vertical pole is not less than an extension length of each top rod. In an embodiment, the extension height of each vertical pole is greater the extension length of each top rod, as shown in FIG. 2, and the folded joint seat is located in the middle of the space enclosed by the vertical poles.

In an embodiment, the number of the vertical poles is four, the connection of any two adjacent vertical poles form a rectangle, the four top rods are arranged crosswise at the top of the vertical poles along radial directions, and the joint seat is located at the cross position. The rectangular structure has high stability, is suitable for lounging, and has a moderate volume after folding.

Figure 4:
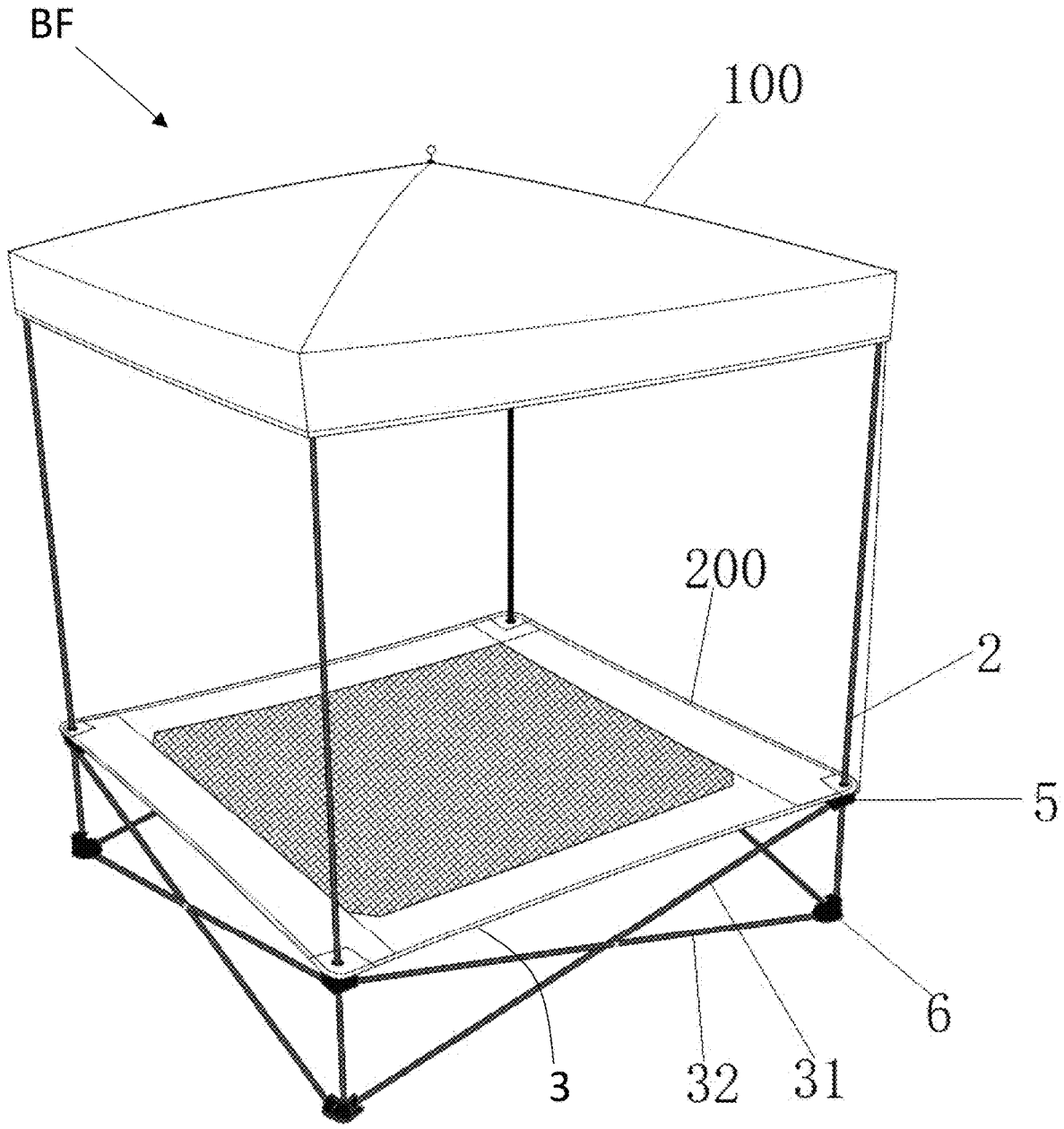
FIG. 4 is a schematic structural view of a bed provided by the present application.

As shown in FIG. 4, a folding bed is provided according to this embodiment, including the above-mentioned bedstead, the mattress 200 and the sunshade 100, where the mattress 200 is sleeved on the vertical poles, the sunshade 100 is sleeved on and/or placed over the top frame and the upper part of the vertical poles, so that the folding bed provided by the present application can provide the functions of lounge, sun shading and rain protection.

In an embodiment, the bed provided by this embodiment is suitable for pet beds.

The folding bedstead provided by the present application can be folded jointly and conveniently, and the folded bedstead has a small packaging volume, which is convenient for users to store, and does not occupy too much space.

In the description of this specification, description involving terms such as "embodiment", "example", etc. means that specific features, structures, materials or characteristics described in conjunction with this embodiment or example are included in at least one embodiment or example of the present application. In this specification, the exemplary expressions of the above terms do not necessarily refer to the same embodiments or examples. Furthermore, the specific features, structures, materials or characteristics described may be combined in a suitable manner in any one or more embodiments or examples.

Although the embodiments of the present application have been shown and described, those skilled in the art can understand that: various changes, modifications, substitutions and variations can be made to these embodiments without departing from the principles and purposes of the present application. The scope of the present application is defined by the claims and their equivalents.

What is claimed is:

1. A bed comprising:

a folding bedstead, the folding bedstead being moveable between a folded configuration and an expanded configuration, the bedstead comprising:

a plurality of vertical poles, when the bedstead is in the expanded configuration, the vertical poles being spaced apart with a connection rod assembly between any two adjacent vertical poles forming a loop around the periphery of the bedstead, the vertical poles each having a top end and bottom end, the connecting rod assembly comprising a connecting rod, the connecting rod assembly being connected to the vertical poles such that the vertical poles are moveable with the connection rod assembly between the expanded and folded configuration of the bedstead by moving the connecting rod assembly;

a top frame which is foldably mounted at the top ends of the plurality of vertical poles, wherein the top frame comprises a plurality of top rods and a joint seat, one end of each of the top rods is rotatably connected to the top end of the respective vertical pole, and the other end of each of the top rods is rotatably connected to the joint seat; and a sliding seat slidably connected to and sleeved around each vertical pole, the sliding seat being vertically slidable relative to the corresponding vertical pole between the top end of the vertical pole and the bottom end of the vertical pole, an upper end of the connecting rod of the connecting rod assembly is rotatably connected with the corresponding sliding seat, and a lower end of the connecting rod of each connecting rod assembly is rotatably connected with a lower side of the adjacent vertical pole.

2. The bed according to claim 1, wherein the joint seat comprises a seat body and a plurality of hinge positions formed at an upper end of the seat body, wherein the plurality of top rods are rotatably connected at the hinge positions respectively, so that the top rods and the joint seat are able to be folded within the vertical poles when the bedstead is moved to the folded configuration.

3. The bed according to claim 1, wherein each connecting rod assembly comprises at least two connecting rods which are arranged crosswise, wherein the two connecting rods are rotatably connected to each other in the middle of each connecting rod.

4. The bed according to claim 3, wherein a support foot is provided at the bottom end of each vertical pole, and a lower end of each connecting rod is pivotally connected to the corresponding support foot.

5. The bed according to claim 1, wherein the number of the vertical poles is four, the connections to the vertical poles form a rectangle, four top rods are arranged crosswise and extend from each of the vertical poles in radial directions relative to the joint seat, and the joint seat is located at a center cross position.

6. The bed according to claim 1, wherein a length of each vertical pole is greater than a length of a corresponding top rod.

7. The bed according to claim 1, wherein an upper part of each sliding seat forms a supporting surface to support a mattress.

8. The bed according to claim 1, comprising:

a mattress sleeved on the vertical poles; and a sunshade which is at least sleeved on the top frame.

9. The bed according to claim 8, wherein the sunshade is sleeved on the top frame and an upper part of the vertical poles.

10. A bed comprising a frame, the frame being movable between a folded configuration and an expanded configuration, the frame comprising:

a plurality of vertical poles, a connecting rod assembly extending between each adjacent vertical pole such that the connecting rod assemblies form a loop that define an outer periphery of the frame when the frame is in the expanded configuration, the connecting rod assembly comprising a connecting rod, the connecting rod assembly being connected to the vertical poles such that the bedstead is moveable between the expanded and folded configuration by moving the connecting rod assembly and the vertical poles;

a top frame comprising a plurality of top rods and a joint seat, one end of each of the top rods is rotatably connected to the top of the respective vertical pole, and the other end of each of the top rods is rotatably connected to the joint seat; and a sliding seat slidably connected to and sleeved around each vertical pole, the sliding seat being vertically slidable relative to the corresponding vertical pole between the top end of the vertical pole and the bottom end of the vertical pole, an upper end of the connecting rod of each connecting rod assembly is rotatably connected with the corresponding sliding seat, and a lower end of the connecting rod of each connecting rod assembly is rotatably connected with a lower side of the vertical pole.

11. The bed according to claim 10, wherein the joint seat comprises a seat body and a plurality of hinge positions formed at an upper end of the seat body, wherein the plurality of top rods are rotatably connected at the hinge positions respectively, so that the top rods and the joint seat are able to be folded within the vertical poles when the frame is moved to the folded configuration.

12. The bed according to claim 11, wherein each connecting rod assembly comprises two connecting rods which are arranged crosswise, wherein the two connecting rods are rotatably connected to each other in the middle of each connecting rod.

13. The bed according to claim 12, wherein a support foot is provided at the bottom end of each vertical pole, and a lower end of each connecting rod is pivotally connected to the corresponding support foot.

14. The bed according to claim 10, wherein the number of the vertical poles is four, the connections to the vertical poles form a rectangle, four top rods are arranged crosswise and extend from each of the vertical poles in radial directions relative to the joint seat, and the joint seat is located at a center cross position.

15. The bed according to claim 10, wherein an extension height of each vertical pole is greater than a length of a corresponding top rod.

16. The bed according to claim 10, wherein an upper part of each sliding seat forms a supporting surface to support a mattress.

17. The bed according to claim 10, comprising:

a mattress sleeved on the vertical poles; and a sunshade which is at least sleeved on the top frame.

18. The bed according to claim 17, wherein the sunshade is sleeved on the top frame and an upper part of the vertical poles.

* * * * *